US005181397A

United States Patent [19]

Battista

[11] Patent Number: 5,181,397

[45] Date of Patent: Jan. 26, 1993

[54] SUBSTITUTE FOR PIERCED EARRINGS

[76] Inventor: Natalie Battista, 3733 Marland Heights Rd., Weirton, W. Va. 26062

[21] Appl. No.: 891,191

[22] Filed: Jun. 1, 1992

[51] Int. Cl.[5] ..... A44C 7/00

[52] U.S. Cl. ..... 63/12; 63/14.2

[58] Field of Search ..... 63/12, 14.1–14.8

[56] References Cited

U.S. PATENT DOCUMENTS

| | | | |
|---|---|---|---|
| 1,582,383 | 4/1926 | Connally | 63/14.2 |
| 1,602,239 | 10/1926 | Miller | 63/14.2 |
| 2,034,052 | 3/1936 | McLeod | 63/14.2 |
| 2,502,386 | 3/1950 | Mailand | 63/14.2 |
| 2,525,195 | 10/1950 | Austrin | 63/14.2 |
| 2,526,087 | 10/1950 | Schoolman | 63/14.2 |
| 2,718,128 | 9/1955 | Richards | 63/14.2 |
| 4,700,552 | 10/1987 | Haley | 63/12 |

FOREIGN PATENT DOCUMENTS

| | | | |
|---|---|---|---|
| 614888 | 12/1926 | France | 63/14.2 |
| 64074 | 10/1955 | France | 63/14.2 |

*Primary Examiner*—Renee S. Luebke
*Assistant Examiner*—Flemming Saether
*Attorney, Agent, or Firm*—H. Jay Spiegel

[57] ABSTRACT

A substitute for pierced earrings includes dual attachment devices which operate together to facilitate attachment of the present invention over the user's ear. In each embodiment, a clip is combined with a hook-like fastener to securely fasten the device on the ear. In one embodiment, an earring covering the entire ear is employed. In another embodiment, a pierced earring may be attached to a base forming a part of the present invention.

14 Claims, 2 Drawing Sheets

SUBSTITUTE FOR PIERCED EARRINGS

BACKGROUND OF THE INVENTION

The present invention relates to a substitute for pierced earrings. In the prior art, earrings are well known, however, Applicant is unaware of any earrings including all of the features and aspects of the present invention. The following prior art is known to Applicant:

U.S. Pat. No. 3,013,408 to Weingreen discloses an earring having a mechanism 18 including a clamp to clamp the device to the user's ear as well as a ring 38 facilitating suspension of an earring therefrom. The present invention differs from the teachings of Weingreen as contemplating dual support mechanisms.

U.S. Pat. No. 3,533,247 to Douglas teaches an earring kit with plural changeable pendants. The device includes a clamping mechanism 24 with a depending chain 22 to which may be attached one of a plurality of pendants. The present invention differs from the teachings of Douglas as contemplating dual attachment means on the ear of the user.

SUMMARY OF THE INVENTION

The present invention relates to a substitute for pierced earrings. The present invention includes the following interrelated objects, aspects and features:

(A) In a first aspect of the present invention, two embodiments are disclosed. In each embodiment, dual fastening means are employed to fasten the inventive substitute for pierced earrings on the user's ear.

(B) A first fastening means consists of a pivotable clip which may be locked in a non-clamping position and which may be pivoted to a clamping position holding the earlobe of the user.

(C) In a first embodiment of the present invention, the second fastening means consists of an elongated chain having a hook-like fastener at a distal end thereof. The hook-like fastener is designed to be hooked over the top of the ear where the ear is connected to the user's head.

(D) In a second embodiment of the present invention, the above-described pivoted clamping means is mounted on an elongated substantially rigid strip with a hook-like fastening means mounted on the other end of the strip. The hook-like fastening means is mounted to the strip on a fitting which may slide within a slot formed in the strip and with the hook connected to the fitting in a manner allowing pivotable adjustment of the hook-like fastener with respect to the fitting.

(E) The first-mentioned embodiment of the present invention includes holes therein designed to receive the fastening wire of a pierced earring therethrough to hold the pierced earring below the user's ear. Additional structure is provided which allows support of additional ornamentation as desired.

(F) In the second-mentioned embodiment, the elongated strip provides a support for a large ornamental design which may cover the entirety As such, it is a first object of the present invention to provide a substitute for pierced earrings.

It is a further object of the present invention to provide such a device including dual fastening means.

It is a still further object of the present invention to provide such a device in two embodiments each of which includes a pivotable fastener as well as a hook-like fastener.

It is a still further object of the present invention to provide such a device in one embodiment wherein the entire ear is covered with ornamentation.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
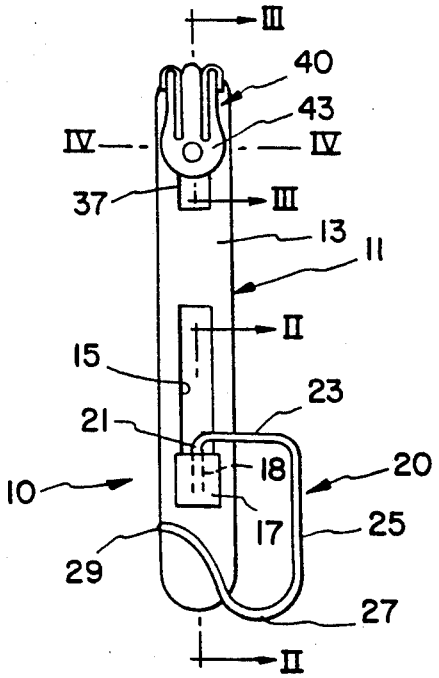
FIG. 1 shows a rear view of a first embodiment of the present invention.

With reference, first, to FIGS. 1-7, a first embodiment of inventive substitute for pierced earrings is generally designated by the reference numeral 10 and is seen to include a body 11 consisting of an elongated strip 13 of generally rigid material such as plastic or metal.

A first elongated slot 15 is provided in the strip 13 and slidably receives a fitting 17 which pivotably carries the hook 20 which includes one end 21 received within an opening 18 in the fitting 17, a right angle bend 23, a further right angle bend 25 and a curved termination 27 having a distal end 29.

Figure 2:
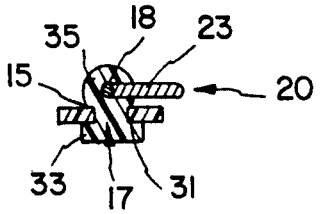
FIG. 2 shows a cross-sectional view along the line II—II of FIG. 1.

As best seen in FIG. 2, the fitting 17 has a narrowed neck portion 31 which is slidably received within the slot 15, an enlarged bottom portion 33 fitting beneath the slot and a bulbus head portion 35 having the opening 18 therein and receiving the hook 20.

Figure 3:
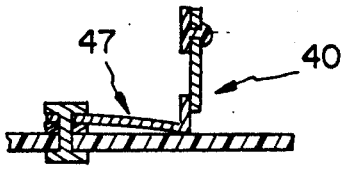
FIG. 3 shows a cross-sectional view along the line III—III of FIG. 1.
Figure 4:
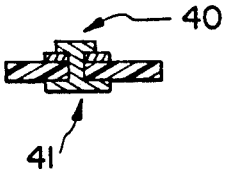
FIG. 4 shows a cross-sectional view along the line IV—IV of FIG. 1.
Figure 5:
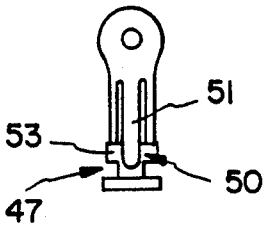
FIG. 5 shows an end view of the embodiment of FIG. 1 with the pivotable member in a raised position.
Figure 6:
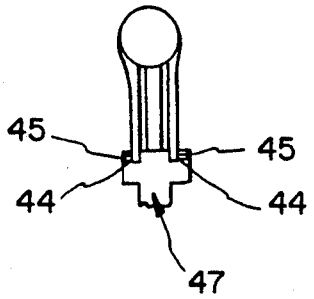
FIG. 6 a view looking in the opposite direction from the view of FIG. 5.

With further reference to FIGS. 1, 3 and 4, a further slot 37 is provided in the strip 13 and slidably receives a fitting 41 which holds clip assembly 40 in place. The clip assembly 40 includes a pivotable clip member 43 which has outwardly extending pivot members 45 (FIG. 6) which extend through openings 44 in a base member 47. In the position of the clip assembly as illustrated in FIG. 1, the clip member 43 may be clipped about the earlobe of the user. The clip member 43 may be pivoted to the position illustrated in FIGS. 3, 5 and 6 wherein a tongue 51 overlies a rear surface 53 of an upstanding portion 50 of the base 47 to lock the clip member 43 in the position shown in FIGS. 3, 5 and 6. Alternatively, the clip member 43 may be pivoted to the position shown in FIG. 1 wherein it locks about the earlobe of the user's ear. The fitting 41 may slide within the slot 37 to adjust the particular position of the clip assembly 40 and also permits rotation of the fitting 41 with respect to the slot 37 with frictional interaction holding the clip assembly 40 in any desired rotative orientation.

Figure 7:
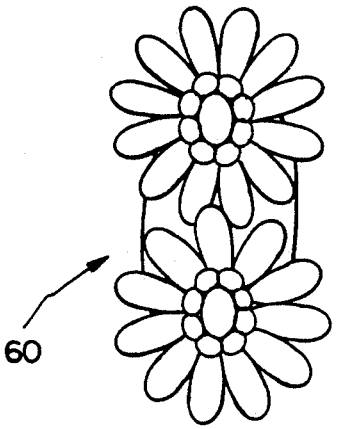
FIG. 7 shows a front view of the embodiment of FIGS. 1-6 with an example of ornamentation incorporated therewith.

FIG. 7 shows a front view of an example of an aesthetic design 60 which may be assembled in any suitable manner to the rear surface of the strip 13. When the design 60 is so assembled to the strip 13, care is taken that the design 60 does not impede any desired sliding or rotative movements of the fittings 17 and 41.

In the preferred mode of operation of the inventive device 10, the hook-like member 20 may be placed over the top of the portion of the ear which connects to the head of the user with the clip assembly 40 being clipped to the user's earlobe. The various adjustments which are possible due to the rotative interconnection between the hook-like member 20 and the fitting 17 as well as the slot 15 in which the fitting 17 rides, along with the rotative and reciprocatory adjustability of the position and orientation of the clip assembly 40, gives the inventive device great versatility and makes it adaptable to ears of differing sizes and configurations.

Figure 8:
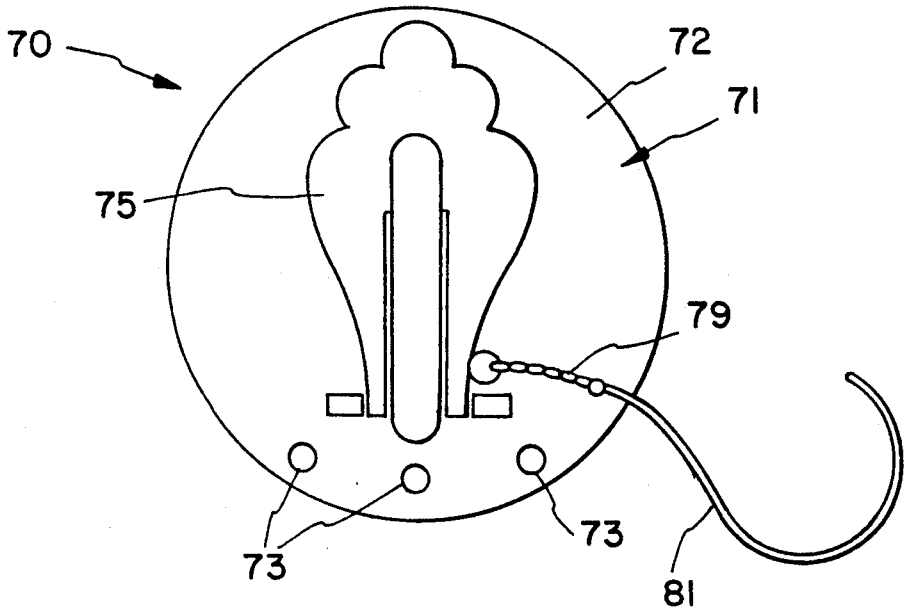
FIG. 8 shows a rear view of a second embodiment of the present invention.
Figure 9:
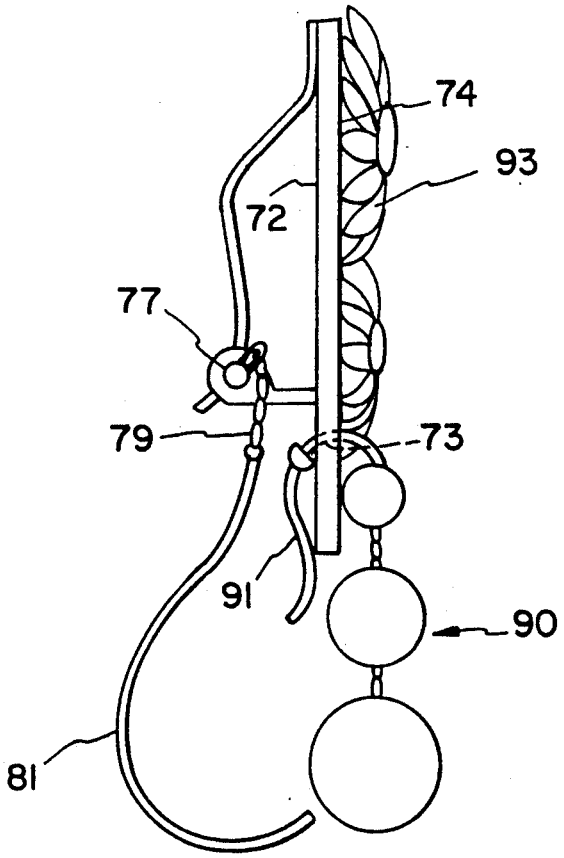
FIG. 9 shows a side view of the embodiment illustrated in FIG. 8.

With reference, now, to FIGS. 8 and 9, a further embodiment of the present invention is generally designated by the reference numeral 70 and is seen to include a backing plate 71 having a plurality of holes 73 therethrough for a purpose to be described in greater detail hereinafter. A clip 75 operating in the same manner as the clip assembly 40 is suitably mounted in fixed position on a rear surface 72 of the plate 71. The clip 75 includes an opening 77 to which is attached an elongated chain 79 having a hook-like member 81 attached thereto. The hook-like member 81 is designed to be looped over the top of the ear where the ear connects to the user's head.

The holes 73 are provided to allow support of one or more pierced earrings 90 including a wire 91 which may be inserted through one of the openings 73 so that the earring 90 may be supported as best seen in FIG. 9. Additionally, the surface 74 of the plate 71 may have an aesthetic design 93 thereon as illustrated in FIG. 9.

In the operation of the embodiment of FIGS. 8 and 9, the clip 75 may be clipped over the earlobe of the user with the hook 81 being hooked over the top of the portion of the ear connected to the head of the user by virtue of the elongation of the chain 79. In this way, the device 70 may be suitably fastened to the user's ear. As so fastened, one or more earrings 90 may be attached to the plate 71 through the use of one or more of the holes 73 while the surface 74 of the plate 72 has a suitable design or ornamentation thereon.

Through the use of the present invention, increased versatility is attained, especially through the use of the embodiment of FIGS. 8 and 9 which includes specific means for attachment of any one of a variety of pierced earrings thereto. Additionally, the embodiment of FIGS. 1-7 contemplates covering the entirety of the user's ear with an aesthetic article of jewelry.

As such, an invention has been disclosed in terms of preferred embodiments thereof which fulfill each and every one of the objects of the present invention and provide a new and useful substitute for pierced earrings, in two embodiments thereof, of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A device for decorating a human ear, said ear including an external ear portion having an earlobe, said external ear portion being connected to a human head at a narrowed connection location having a peripheral surface with a top portion, said device comprising a flat, generally straight elongated body having a front surface and a rear surface, said front surface having an ornamental design thereon, said rear surface facing means for connecting said body to said ear, said connecting means comprising:

a) an elongated slot formed in one end of said body and slidably receiving a first fitting, said first fitting carrying a hook including a straight portion rotatably received within an opening in said fist fitting whereby rotative and longitudinal positions of said hook with respect to said body may be selectively adjusted;

b) a second fitting mounted at another end of said body and carrying a pivotable clip;

c) said hook being engageable over said top portion of said connection location of said external ear portion while said clip is releasably attachable to said earlobe.

2. The device of claim 1, wherein said body has a further slot formed therein and slidably receiving said second fitting.

3. The device of claim 2, said clip being lockable in clamping and released positions thereof.

4. The device of claim 2, wherein said second fitting is also rotatable received in said further slot.

5. The device of claim 1, wherein said body has a longitudinal axis, said slot extending therealong.

6. The device of claim 5, wherein rotations of said hook are with respect to a rotation axis which is parallel to said longitudinal axis.

7. The device of claim 6, wherein said second fitting is rotatably mounted on said body fro rotations about a further rotation axis perpendicular to said longitudinal axis.

8. A device for decorating a human ear, said sear including an external ear portion having an earlobe, said external ear portion being connected to a human head at a narrowed connection location having a peripheral surface e with a top portion, said device comprising a flat, generally straight elongated body having a front surface and a rear surface, said front surface having an ornamental design thereon, said rear surface facing means for connecting said body to said ear, said connecting means comprising:

a) an elongated slot formed in one end of said body and slidably receiving a first fitting carrying a pivotable clip;

b) a second fitting mounted at another end of said body and carrying a hook including a straight portion rotatably received within an opening in said second fitting whereby said hook may be rotatably adjusted with respect to said body;

c) said hook being engageable over said top portion of said connection location of said external ear portion while said clip is releasably attachable to said earlobe.

9. The device of claim 8, wherein said body has a further slot formed therein and slidably receiving said second fitting.

10. The device of claim 9, wherein said clip is lockable in clamping and released positions thereof.

11. The device of claim 9, wherein said first fitting is rotatably received in said elongated slot.

12. The device of claim 8, wherein said body has a longitudinal axis, said slot extending therealong.

13. The device of claim 12, wherein rotations of said hook are with respect to a rotation axis which is parallel to said longitudinal axis.

14. The device of claim 13, wherein said first fitting is rotatably mounted on said body for rotations about a further rotation axis perpendicular to said longitudinal axis.

* * * * *